United States Patent [19]

Hirooka et al.

[11] 4,000,958

[45] Jan. 4, 1977

[54] METHOD FOR TREATING LEATHER

[75] Inventors: Masaaki Hirooka, Kyoto; Yoshikazu Fujii, Ibaragi; Kazuhiko Hata, Takatsuki, all of Japan

[73] Assignee: Sumitomo Chemical Company, Limited, Osaka, Japan

[22] Filed: Apr. 14, 1975

[21] Appl. No.: 567,846

[30] Foreign Application Priority Data

Apr. 17, 1974 Japan ..... 49-43761

[52] U.S. Cl. ..... 427/389; 8/12; 8/74; 8/94.21

[51] Int. Cl.[2] ..... B05D 3/02

[58] Field of Search ..... 8/94.21, 12, 74; 427/389

[56] References Cited

UNITED STATES PATENTS

| | | | |
|---|---|---|---|
| 2,725,367 | 11/1955 | Niederhauser | 8/94.21 X |
| 2,824,816 | 2/1958 | Somerville et al. | 427/389 X |
| 2,828,220 | 3/1958 | McWherter et al. | 8/94.21 X |
| 3,269,858 | 8/1966 | Mattei | 427/389 |
| 3,291,558 | 12/1966 | Bader et al. | 8/94.21 |
| 3,744,969 | 7/1973 | Alps et al. | 427/389 X |

*Primary Examiner*—Michael R. Lusignan
*Attorney, Agent, or Firm*—Stevens, Davis, Miller & Mosher

[57] ABSTRACT

A method for treating a leather, characterized by treating a leather with a polymer [II] obtained by polymerizing 5 to 2,000 parts by weight of at least one member selected from the group consisting of acrylic esters and methacrylic esters in which the alcohol moiety is a hydrocarbon- or halohydrocarbon-group having 1 to 20 carbon atoms, and 500 parts by weight or less of at least one vinyl compound having the formula:

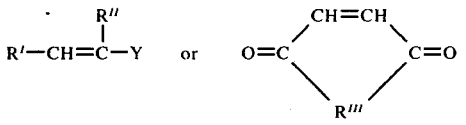

wherein $R^I$ and $R^{II}$ are independently a hydrogen atom, a halogen atom, a hydrocarbon- or halohydrocarbon-group having 1 to 8 carbon atoms, or Y; Y is a group having 1 to 20 carbon atoms and having a group selected from the group consisting of a carboxyl group, acid halide groups, a hydroxyl group, ether groups, and oxygen-containing cyclic compound residues; $R^{III}$ is an oxygen atom or $>N\text{-}R^{IV}$ wherein $R^{IV}$ is a hydrogen atom or a hydrocarbon- or halohydrocarbon-group having 1 to 8 carbon atoms, in the presence of 100 parts by weight of a copolymer [I] comprising as essential components at least one monoethylenically unsaturated ester compound having 4 to 22 carbon atoms, at least one member selected from the group consisting of monoethylenically unsaturated hydrocarbon compounds having 2 to 20 carbon atoms and halogen-substituted derivatives thereof and, if necessary, at least one diene or polyene compound. The thus treated leather causes no color bleed, has no tackiness, and has a coating film high in strength and impact resistance.

48 Claims, No Drawings

METHOD FOR TREATING LEATHER

This invention relates to a method for treating a leather, and more particularly, to a method for preventing the color bleeding of a leather colored with dyes or high-grade pigments.

In coating a leather, it is required to impart a proper combination of physical properties and chemical properties to the leather. That is to say, it is generally required to impart, above all, protective functions, i.e., resistance to abrasion, moisture, alcohols, gasoline, grease, acids, alkalis, salts, heat, and light. Decorative function is also important. That is, such properties as gloss, smoothness and texture are important in this field.

DISCUSSION OF THE PRIOR ART

For imparting this kind of function to a leather, there has already been known a method of treating a leather with a solution containing as the major component a vinyl chloride-acrylic ester copolymer, polyurethane, nylon, amino acid resin, or the like, and according to this method, the desired properties have successfully been imparted to the leather. However, this kind of treating method is disadvantageous in that the phenomenon of bleeding of dyes or the like cannot sufficiently be inhibited when various kinds of dyes, high-grade pigments or the like are used as a coloring agent for natural, artificial or synthetic leathers in order to impart thereto a vivid and transparent tone which is the recent trend. The aforesaid color bleeding phenomenon brings about such a trouble that, for example, when pieces of leather the surfaces of which have been conventionally treated are put one on another and a pressure is applied to the resulting assembly, the coloring agent on the surface of each piece migrates to the surface of the other to stain the surfaces extremely. Such a phenomenon actually occurs, for example, when pieces of colored leather put one on another are sewn or when a large number of leather pieces are left placed one on another.

There has been eagerly awaited the advent of a method for treating a leather, which can impart to the leather both various properties required for a leather surface and ability to prevent the above-mentioned color bleeding phenomenon.

In order to solve the above problem, the present inventors conducted extensive research and as a result, found a new method for treating a leather which has not the aforesaid disadvantages and disclose said method in the specification of U.S. patent application Ser. No. 357,658, now abandoned. They have proceeded with further studies in this field and consequently have found an effective method for preventing the color bleeding of a leather colored with dyes or high-grade pigments.

An object of this invention is to provide a method for treating a leather.

Another object of this invention is to provide a method for preventing the color bleeding of a leather colored with dyes or high-grade pigments.

A further object of this invention is to provide a method for treating a leather, which can impart to the leather both various properties required for a leather surface and ability to prevent the color bleeding.

Other objects and advantages of this invention will be apparent from the following description.

SUMMARY OF THE INVENTION

According to this invention, there is provided a method for treating a leather, which comprises treating a leather with the polymer [II] obtained by polymerizing 5 to 2,000 parts by weight of at least one member selected from the group consisting of acrylic esters and methacrylic esters in which the alcohol moiety is a hydrocarbon- or halohydrocarbon-group having 1 to 20 carbon atoms with 500 parts by weight or less of at least one vinyl compound having the formula:

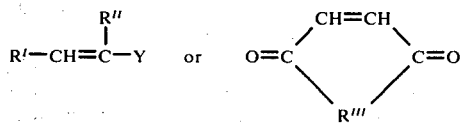

wherein $R^I$ and $R^{II}$ are independently a hydrogen atom, a halogen atom, a hydrocarbon- or halohydrocarbon-group having 1 to 8 carbon atoms, or Y; Y is a group having 1 to 20 carbon atoms and also having a group selected from the group consisting of a carboxyl group, acid halide groups, a hydroxyl group, ether groups, and oxygen-containing cyclic compound residues; $R^{III}$ is an oxygen atom or $>N\text{-}R^{IV}$ wherein $R^{IV}$ is a hydrogen atom or a hydrocarbon- or halohydrocarbon-group having 1 to 8 carbon atoms, in the presence of 100 parts by weight of a copolymer [I] comprising as essential components at least one monoethylenically unsaturated ester compound having 4 to 22 carbon atoms and at least one member selected from the group consisting of monoethylenically unsaturated hydrocarbon compounds having 2 to 20 carbon atoms and halogen-substituted derivatives thereof.

DETAILED DESCRIPTION OF THE INVENTION

Although the color bleeding of a leather colored with dyes or high-grade pigments can be sufficiently prevented by the use of the copolymer [I] in this invention, some leathers are given undesirable tackiness by the application of the copolymer thereto. For avoiding this, it is extremely effective to effect further polymerization in the presence of the copolymer [I] to obtain the polymer [II]. According to said method, there can be obtained a coating film which is high in strength and moreover has high impact resistance.

In this invention, the copolymer [I] is important for imparting flexibility to a coating film and for maintaining the color-bleed-preventing effect, and the post-polymerization imparts thereto strengths and non-tackiness.

When the polymer [II] is prepared by effecting the further polymerization in the presence of the copolymer [I], a homogeneous solution of the polymer [II] can be obtaind by selecting suitable monomer components and solvents to be used in the preparation of the polymer [II], even if no chemical change takes place in the copolymer [I]. When the copolymer [I] has polymerizable unsaturated groups or such groups as can induce graft-copolymerization by the extraction of a hydrogen atom or the like therefrom, a homogeneous solution can be obtained particularly readily. The above-mentioned groups are, as well known, unsaturated groups, such as alkenyl, aralkenyl, alkenylaryl, and cycloalkenyl, or those groups which have, for example, an active hydrogen excited by an unsaturated bond.

The copolymer [I] in this invention comprises, as essential components, [III] at least one monoethylenically unsaturated ester compound having 4 to 22 carbon atoms, and [IV] at least one member selected from the group consisting of monoethylenically unsaturated hydrocarbon compounds having 2 to 20 carbon atoms and halogen-substituted derivatives thereof, and is preferably an alternating copolymer of [III] and [IV].

The proportion of the constituent [III] in the copolymer [I] is preferably 20 to 80, more preferably 30 to 70, most preferably about 50 mole percent, and the balance is of the constituent [IV].

The monoethylenically unsaturated ester compound [III] has 4 to 22 carbon atoms and may be either an ester of an unsaturated carboxylic acid or an unsaturated ester of a carboxylic acid. These compounds are preferably esters of aliphatic carboxylic acids, aromatic carboxylic acids, cycloaliphatic carboxylic acids, mixtures of these carboxylic acids, or halogen-substituted derivatives of these acids. As the alcohol moiety of said ester, there are usually used hydrocarbon- or halohydrocarbon-groups such as alkyl, alkenyl, aryl, aralkyl, aralkenyl, alkylaryl, alkenylaryl, cycloalkyl, and cycloalkenyl, or halogensubstituted derivatives thereof. In particular, esters of unsaturated carboxylic acids can readily bring about desirable results. Examples of the esters of unsaturated carboxylic acids include acrylic esters, methacrylic esters, crotonic esters, itaconic esters, maleic esters, fumaric esters, and the like, and among them acrylic esters and methacrylic esters are often used. More concrete examples thereof include methyl acrylate, ethyl acrylate, butyl acrylate, octyl acrylate, stearyl acrylate, methyl methacrylate, ethyl methacrylate, butyl methacrylate, octyl methacrylate, stearyl methacrylate, ethyl crotonate, diethyl itaconate, diethyl maleate, diethyl fumarate, chloromethyl acrylate, chloroethyl acrylate, chloromethyl methacrylate, chloroethyl methacrylate, etc. These esters may be used alone or in admixture of two or more.

The unsaturated esters of carboxylic acids include esters containing, in the ester group, vinyl, vinylidene or vinylene group, and vinyl ester compounds such as, for example, vinyl esters of fatty acids are particularly preferred. More concrete examples of these esters include vinyl acetate, vinyl propionate, vinyl butyrate, vinyl laurate, vinyl benzoate, vinyl norbornanecarboxylate, vinyl chloroacetate, allyl acetate, etc. These esters may be used alone or in admixture of two or more.

The monoethylenically unsaturated hydrocarbon compounds or halogen-substituted derivatives thereof [IV] include olefins and haloolefins having 2 to 20 carbon atoms, preferably 3 to 20 carbon atoms, and as said compounds, there are widely used aliphatic, aromatic, and cylloaliphatic compounds, either terminally or internally unsaturated compounds of which may be used. Aliphatic $\alpha$-olefins are particularly preferred, and, among them, isobutylene and propylene are particularly useful. Concrete examples of these compounds include ethylene, propylene, isobutylene, butene-1, pentene-1, 2-methylbutene-1, 2-methylpentene-1, hexene-1, butene-2, 4-methyl-pentene-1, 2-methyl-4-phenylbutene-1, octadecene-1, vinyl chloride, vinylidene chloride, 3-methallyl chloride, 2-methyl-4-chloropentene-1, norbornene, indene, styrene, $\alpha$-methylstyrene, vinyltoluene, $\alpha$-chlorostyrene, p-chlorostyrene, p-bromostyrene, etc. These compounds may be used alone or in admixture of two or more.

When a polymerizable unsaturated group or such a group as can induce graft-polymerization by extraction of, for example, a hydrogen atom therefrom is introduced into the copolymer [I] consisting of constituents [III] and [IV], a homogeneous solution of the polymer [II] can readily be obtained in the preparation of the polymer [II] from the copolymer [I]. The above introduction can be carried out by copolymerizing at least one monomer having the afore-said groups together with other monomers at the time of the preparation of the copolymer [I], or by effecting polymer reaction, and the former method is particularly advantageous. Preferable groups are such unsaturated groups as alkenyl, aralkenyl, alkenylaryl, and cycloalkenyl, or those groups which have, for example, active hydrogen excited by an unsaturated bond, and these groups can be introduced into either the main chain or side chain in the copolymer [I].

The above group can be introduced into the copolymer [I] in any proportion, though it is effective for the above group to be contained in a proportion of 0.01 to 30, preferably 0.1 to 10, mole percent in the copolymer [I].

As preferable monomers which give the above-mentioned groups to the copolymer [I], various diene compounds or polyene compounds may be used. It is particularly preferable that a part of the essential constituent [III] or [IV] of copolymer [I] is replaced by at least one diene compound or polyene compound. As the above-mentioned diene compounds and polyene compounds, there may particularly preferably be used ethylenically unsaturated ester compounds having at least two polymerizable double bonds and 5 to 22 carbon atoms. There may also be used ethylenically unsaturated hydrocarbons compounds having 4 to 20 carbon atoms and at least two polymerizable double bonds, or halogen-substituted derivatives thereof.

As the ethylenically unsaturated ester compounds having at least two polymerizable double bonds, unsaturated ester compounds of acrylic acid are particularly effective. The examples of said compounds include vinyl acrylate, allyl acrylate, isobutenyl acrylate, 1'-butenyl acrylate, crotyl acrylate, cynnamyl acrylate, 3'-cyclopentenyl acrylate, citronellyl acrylate, geranyl acrylate, 5'-norbornen-2'-yl-methyl acrylate, $\beta$-chloroallyl acrylate, cyclohexenyl acrylate, etc.

Concrete examples of ethylenically unsaturated hydrocarbon compounds having at least two double bonds capable of replacing constituent [IV], or halogen-substituted derivatives thereof include butadiene isoprene, chloroprene, 1,5-hexadiene, divinyl benzene, p-isopropeneyl styrene, p-allyl styrene, 5-ethylidene-2-norbornene, 5-methyl-2,5-norbornadiene, dicyclopentadiene, 1,5-cyclooctadiene, 6-methyl-4,7,8,9-tetrahydroindene, 4-vinyl-cyclohexene, aldoline, p-1'-chloro-1'-propenyl-styrene, etc.

Copolymerization of the constituents [III] and [IV] for the preparation of the copolymers [I] used in the present invention may be carried out in any polymerizing method, and in order to obtain a high molecular weight copolymer, the addition of a Lewis acid capable of forming a complex with the carbonyl group of the acrylate, such as a metal halide or the like, gives a favorable result because a degradative chain-transfer reaction due to the constituent [IV] becomes difficult to occur. As this kind of Lewis acid, any compound capable of forming a complex with a lone pair of electron of the carbonyl group may be used and, for example, halides of elements of Group II*b*, III*b*, IV*b*, V*b* and VIII of the Mendeleev Periodic Table, particularly halides of aluminum, boron, zinc, tin and the like are effective. For example, there may be exemplified aluminum chloride, alkylaluminum halides, boron trichloride, boron trifluoride, alkylboron halides, zinc chloride, stannic tetrachloride, alkyltin halides, and the like. This complex copolymerization is initiated and promoted by a radical polymerization catalyst, oxygen, organometallic compounds, light, radiations and the like.

The particularly important reaction is a copolymerization reaction which produces an alternating copolymer. In order to obtain an alternating copolymer effectively, a system in which an aluminum or boron compound is used as a catalyst is particularly preferable. These polymerization methods are described in detail in, for example, British Pats. No. 1,187,105 and 1,280,030. That is, these systems form a complex with the carbonyl group of the acrylate, and simultaneously the organoaluminum halide or organoboron halide acts as an initiator to give an alternating copolymer effectively. The particularly preferable system is a system in which an organoaluminum halide or an organoboron halide or a component equivalent thereto is employed.

The copolymer [I] consisting of the constitutents [III] and [IV] can further be converted into a reacting-type polymer by introducing a functional group having reactivity thereinto. This introduction can be carried out by copolymerizing at least one third component monomer having a functional group together with the monomers [III] and [IV], or be effecting polymer reaction. As the aforesaid functional group, there may be employed the same functional groups as commonly used for imparting reactivity to known acrylic ester polymers, and, besides them, any of other functional groups may be introduced thereinto.

These functional groups can be introduced into the copolymer [I] in any proportion, though they can bring about desirable results when introduced into the copolymer [I] in a proportion of 0.01 to 30, preferably 0.1 to 10, mole percent based on the mole of the copolymer [I]. The polymers containing these functional groups react with themselves when exposed to heat, light, water, or other reagents, or are crosslinked simply by removal of the solvent, and hence are useful for improving the durability and other properties of the polymer [II].

The acrylic and methacrylic esters [V] to be polymerized in the presence of the copolymer [I] to obtain the polymer [II] in this invention are esters containing, as the alcohol moiety, a hydrocarbon- or halohydrocarbon-group having 1 to 20 carbon atoms, which can help copolymerization of the vinyl compound [VI] having a functional group described hereinafter, and are useful for effectively distributing the functional groups, and moreover have an ability to maintain the color-bleed-preventing effect sufficiently without inhibiting the effect.

As the alcohol moieties of the aforesaid esters, there are often used, for example, alkyl, aryl, aralkyl, alkylaryl, cycloalkyl, alkenyl, aralkenyl, alkenylaryl and cycloalkenyl groups and halogen-substituted derivatives thereof.

Specifically, there may be exemplified, for example, methyl acrylate, ethyl acrylate, butyl acrylate, octyl acrylate, stearyl acrylate, methyl methacrylate, ethyl methacrylate, butyl methacrylate, octyl methacrylate, stearyl methacrylate, chloromethyl acrylate, chloroethyl acrylate, chloromethyl methacrylate, chloroethyl methacrylate, etc.

In this invention, a suitable functional group may be introduced into the polymer [II] in order to prevent the color bleeding of a colored leather more effectively and allow the polymer [II] to adhere to the colored leather more firmly. Examples of preferable functional groups are carboxyl group, acid anhydride group, acid halide group, hydroxyl group, ether group, epoxy group, and the like. In particular, the functional vinyl compounds [VI] to introduced into the polymer [II] by copolymerization are vinyl compounds having the formula:

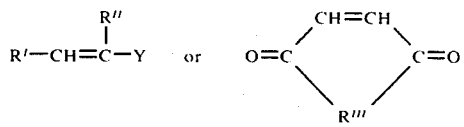

wherein $R^I$ and $R^{II}$ are independently a hydrogen or halogen atom, a hydrocarbon- or halohydrocarbon-group having 1 to 8 carbon atoms, or Y; Y is a group having 1 to 20 carbon atoms and having a functional group selected from the group consisting of a carboxyl group, acid halide groups, a hydroxyl group, ether groups, and oxygen-containing cyclic compound residues; $R^{III}$ is an oxygen atom or $>N\text{-}R^{IV}$; and $R^{IV}$ is a hydrogen atom, or a hydrocarbon- or halohydrocarbon-group having 1 to 8 carbon atoms. As the hydrocarbon- or halohydrocarbon-groups, there are preferably used alkyl, alkenyl, aryl, alkylaryl, aralkyl, and cycloalkyl groups and halogen-substituted derivatives thereof. Examples of preferable vinyl compounds include acrylic acid, acryloyl halides, glycidyl acrylate, maleic anhydride, maleimides, fumaric acid, maleic acid, and substitution derivatives thereof.

Concrete examples of the monomers suited for the above-mentioned purpose, which are used alone or in combination, are acrylic acid, methacrylic acid, crotonic acid, itaconic acid, acryloyl chloride, methacryloyl chloride, methacryloyl bromide, hydroxyethyl acrylate, hydroxyethyl methacrylate, methoxyethyl acrylate ethoxyethyl acrylate, methoxyethyl methacrylate, ethoxyethyl methacrylate, methyl vinyl ether, ether vinyl ether, 2-chloroethyl vinyl ether, glycidyl acrylate, glycidyl methacrylate, maleic anhydride, maleimide, N-methylmaleimide, fumaric acid, maleic acid, and the like.

In preparing the polymer [II] in this invention, 5 to 2,000, preferably 50 to 1,000 parts by weight of at least one member selected from the group consisting of acrylic and methacrylic esters [V], and 500 or less, preferably 0.1 to 200, parts by weight of at least one vinyl compound [VI] having a functional group are polymerized in the presence of 100 parts be weight of the copolymer [I].

The above polymerization for obtaining the copolymer [II] can be effected in a well-known manner. That is to say, the polymer [II] is prepared by subjecting at least one member selected from the group consisting of acrylic and methacrylic esters [V] and at least one viny compound [VI] having a functional group to radical polymerization with a certain kind of initiator, ionic polymerization, or polymerization with light, heat, radiation, or the like, in the presence of the copolymer [I].

The type of polymerization may be varied depending upon the kind of monomer and the polymerization conditions and includes mass polymerization, solution polymerization, emulsion polymerization, and suspension polymerization and combinations thereof. However, other polymerization types must be adopted when some monomers and initiators are used, for example, when the monomers are reacted or decomposed by the action of water.

A method in which a radical-generating catalyst is used is particularly preferable for preparing the copolymer [II]. There may be used, for example, peroxides, oxygen, azo compounds, heat, light, radiation, organometallic compounds and the like may be used as the catalyst. A suitable redox catalyst is often used.

The copolymer [II] used in this invention may be applied to the surface of a leather, and, other treating agents may be applied to the resulting coating film of the copolymer [II] in order to adjust the gloss, smoothness, and texture of the product.

The copolymer [II] may be used in admixture with other polymers or inorganic powders in order to adjust the gloss, smoothness, and texture of the product.

In treating a leather with the treating agent of this invention, any method may be used, though it is particularly preferable to coat the leather surface with a solution of the treating agent in an organic solvent. As the solvent, there may preferably be used aromatic hydrocarbons, halohydrocarbons, ketones, ethers, esters, amides and the like. Examples of these compounds include benzene, toluene, xylenes, perchloroethylene, trichloroethylene, acetone, methyl ethyl ketone, ethyl acetate, tetrahydrofuran, 1,4-dioxane, cyclohexanone, dimethylformamide, etc. Although the solution concentration is not critical, there is often used a solution having a concentration of, for example, 1 to 50% by weight, preferably 5 to 30% by weight. The viscosity of the solution is preferably 1 to 100,000 centipoises, particularly preferably 10 to 1,000 centipoises. The solution is applied to a leather by various methods such as brushing, spraying, dipping, or knife coating, in a proportion of 0.01 to 100 g, preferably 1 to 50 g, in terms of solids per square meter, and then dried at a temperature of from ordinary temperature to 200° C. Alternatively, the treating agent of this invention can be applied to a leather in the form of an aqueous or oily dispersion, or in the form of a melt, as in the case of hot melt.

The thus obtained coating film has excellent performance characteristics required for a leather surface, and suitable gloss and smoothness, and is further improved in such properties as adhesion to leather, solvent resistance, and water resistance.

It is one of the characteristics of this invention that the leather treated by the method of this invention has an improved ability to prevent color bleeding, and colorants which can be protected from color bleeding include dyes and organic pigments. As the dyes, there may be specificially exemplified direct dyes, acid dyes, metal-containing dyes, cationic dyes, oil-soluble dyes, and reactive dyes, though the dyes are not restricted thereto. Among these dyes, metal-containing dyes, acid dyes, and oilsoluble dyes are preferably used in particular.

The term "leather" used herein means a leather comprising a natural or synthetic high polymer substance, and preferable are leathers comprising a natural or synthetic high polymer substance, and having a colored surface layer composed mainly of —HNCO— linkage. The grain layer of said substance may consist of either the same components as or different components from those in the surface layer. Accordingly, the method of this invention can preferably be applied not only to natural leather, polyurethane leather, polyamide leather, and amino acid leather themselves but also to those natural, polyamide, amino acid, polyurethane, vinyl chloride leathers which are coated with a colored surface layer composed mainly of —HNCO— linkage.

This invention is further explained in more detail referring to Examples, which are not by way of limitation but by way of illustration.

EXAMPLE 1

Into a 10-liter separable flask equipped with a reflux condenser and a thermometer, which flask had completely been purged with nitrogen, were charged 4373 g of ethyl acetate as a solvent, 2561 g of a toluene solution containing 20.8% by weight of a quinquepolymer of 45 mole % of isobutylene, 5 mole % of styrene, 40 mole % of ethyl acrylate, 5 mole % of allyl acrylate, and 5 mole % of acryloyl chloride, which had an intrinsic viscosity of 0.91 dl/g as measured in toluene at 30° C, 853 g of methyl methacrylate, 213 g of glycidyl methacrylate, and 18.5 g of benzoyl peroxide as a polymerization initiator. The resulting mixture was subjected to polymerization at 80° C for 8 hours.

The thus obtained polymer solution was applied, to a thickness of 1 mm, by means of an applicator to a polyurethane leather colored with "Suminol Milling Black B" (a registered trademark for a dye of Sumitomo Chemical Co., Ltd.), and dried at 120° C for 1 minute.

Thereafter, the thus treated colored polyurethane leather was put on an untreated white polyurethane leather so that the treated surface of the former contacted with the latter over an area of 6 cm × 6 cm. The resulting assembly was dipped in water, and then pressed by hand to remove water thoroughly, after which a load of 2 kg was applied to the assembly, while holding the assembly between two glass plates, at 70° C for 4 hours, and thereafter the strength of the color transferred from the colored leather to the white leather by bleeding was determined be comparison with the gray scale for assessing staining (JIS L-0805-1965).

The rating ranges from 1 to 5, and larger numerical values show less color bleed, and larger numerical values show more reduced color bleeding. The colored leather treated as mentioned above showed a rating of 5. For comparison, an untreated colored leather was tested for color bleeding under a wet condition, to find that the rating was 1.

The color bleeding under a dried condition was determined by the same testing method as mentioned above, after a leather was allowed to stand under a load of 3.6 kg at 100° C for 4 hours without dipping in water, and, as a result, the treating leather showed a rating of 4, while the untreated leather showed a rating of 1. Either of the thus tested leathers had no tack.

EXAMPLE 2

In the same manner as in Example 1, 112 g of methyl ethyl ketone and 112 g of ethanol were charged into a 500-cc separable flask as a solvent, followed by adding thereto 73 g of a toluene solution containing 24.0% by weight of a quadripolymer of 45 mole % of isobutylene, 5 mole % of styrene, 45 mole % of ethyl acrylate, and 5 mole % of allyl acrylate, which had an intrinsic viscosity of 1.42 dl/g as measured in toluene at 30° C, 42 g of methyl methacrylate, 10.5 g of 2-hydroxyethyl methacrylate and 0.6 of benzoyl peroxide as a polymerization initiator. The resulting mixture was subjected to polymerization at 80° C for 8 hours.

The thus obtained polymer solution was subjected to color bleeding test in the same manner as in Example 1 to find that the rating was 5 under a wet condition and 4 under a dried condition. No tack was observed.

EXAMPLE 3

In the same manner as in Example 1, 474 g of ethyl acetate as a solvent was charged into a 1-liter separable flask followed by adding thereto 221 g of a toluene solution containing 24.1% by weight of a quinquepolymer of 45 mole % of isobutylene, 5 mole % of styrene, 40 mole % of ethyl acrylate, 5 mole % of allyl acrylate and 5 mole % of acryloyl chloride, which had an intrinsic viscosity of 0.88 dl/g as measured in toluene at 30° C, 85 g of methyl methacrylate, 13 g of ethyl acrylate, 8.5 g of acryloyl chloride, and 2.0 g of benzoyl peroxide as a ppolymerization initiator. The resulting mixture was subjected to polymerization at 80° C for 8 hours.

The thus obtained polymer solution was subjected to color bleeding test in the same manner as in Example 1 to find that the rating was 4 under a wet condition and 4 under a dried condition. No tack was observed.

EXAMPLE 4

In the same manner as in Example 1, 155 g of ethyl acetate as a solvent was charged into a 500-cc separable flask, followed by adding thereto 141 g of a toluene solution containing 19.1% by weight of a quinquepolymer of 45 mole % of isobutylene, 5 mole % of styrene, 40 mole % of ethyl acrylate, 5 mole % of allyl acrylate, and 5 mole % of acryloyl chloride, which had an intrinsic viscosity of 1.15 dl/g as measured in toluene at 30° C, 47 g of methyl methacrylate, 6.7 g of 2-methoxyethyl acrylate, and 0.9 of benzoyl peroxide as a polymerization initiator. The resulting mixture was subjected to polymerization at 80° C for 4 hours.

The thus obtained polymer solution was subject to color bleeding test in the same manner as in Example 1, to find that the rating was 4 under a wet condition and 4 to 5 under a dried condition. No tack was observed.

EXAMPLE 5

In the same manner as in Example 1, 225 g of methyl ethyl ketone as a solvent was charged into a 500-cc separable flask, followed by adding thereto 73 g of a toluene solution containing 24% by weight of a quadripolymer of 45 mole % of isobutylene, 5 mole % of styrene, 45 mole of ethyl acrylate, and 5 mole % of allyl acrylate, which had an intrinsic viscosity of 1.42 dl/g as measured in toluene at 30° C, 42 g of methyl methacrylate, 10.5 g of maleic anhydride, and 1.0 g of benzoyl peroxide as a polymerization initiator. The resulting mixture was subjected to polymerization at 80° C for 8 hours.

The thus obtained polymer solution was subjected to color bleeding test in the same manner as in Example 1, to find that the rating was 4 under a wet condition and 4 to 5 under a dried condition. No tack was observed

EXAMPLE 6

In the same manner as in Example 1, 185 g of 1,4-dioxane as a solvent was charged into a 500-cc separable flask, followed by adding thereto 112 g of a toluene solution containing 24.0% by weight of a quadripolymer of 45 mole % of isobutylene, 5 mole % of styrene, 45 mole % of ethyl acrylate, and 5 mole % of allyl acrylate, which had an intrinsic viscosity of 1.42 dl/g as measured in toluene at 30° C, 43 g of n-butyl methacrylate, 11 g of methacrylic acid, and 0.9 g of benzoyl peroxide as a polymerization initiator. The resulting mixture was subjected to polymerization at 80° C for 8 hours.

The thus obtained polymer solution was subjected to color bleeding test in the same manner as in Example 1 to find that the rating was 4 under a wet condition and 4 to 5 under a dried condition. No tack was observed.

EXAMPLE 7

In the same manner as in Example 1, 250 g of 1,4-dioxane as a solvent was charged into a 500-cc separable flask, followed by adding thereto 98 g of a toluene solution containing 23.8% by weight of a terpolymer of 50 mole % of isobutylene, 45 mole % of methyl acrylate, and 5 mole % of allyl acrylate, which had an intrinsic viscosity of 1.05 dl/g as measured in toluene at 30° C, 47 g of methyl methacrylate, and 0.6 g of benzoyl peroxide as a polymerization initiator. The resulting mixture was subjected to polymerization at 90° C for 5 hours.

The thus obtained polymer solution subjected to color bleeding test in the same manner as in Example 1 to find the rating was 4 to 5 under a wet condition and 4 under a dried condition. No tack was observed.

What is claimed is:

1. A method for treating a leather, which comprises treating a leather with a copolymer [II] obtained by polymerizing 5 to 2,000 parts by weight of at least one member selected from the group consisting of acrylic esters and methacrylic esters which contain, as the alcohol moiety, a hydrocarbon- or halohydrocarbon-group having 1 to 20 carbon atoms, and 500 parts by weight or less of at least one vinyl compound having the formula:

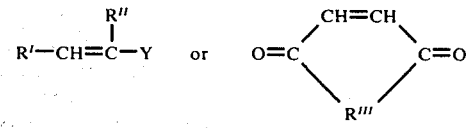

wherein $R^I$ and $R^{II}$ are independently a hydrogen atom, a halogen atom, a hydrocarbon- or halohydrocarbon-group having 1 to 8 carbon atoms, or Y; Y is a group having 1 to 20 carbon atoms and having a group selected from the group consisting of a carboxyl group, acid halide groups, a hydroxyl group, ether groups, and oxygen-containing cyclic compound residues; $R^{III}$ is an oxygen atom or $>N\text{-}R^{IV}$ wherein $R^{IV}$ is a hydrogen atom or a hydrocarbon- or halohydrocarbon-group having 1 to 8 carbon atoms, in the presence of 100 parts by weight of a coplymer [I] comprising as essential components at least one monoethylenically unsaturated ester compound having 4 to 22 carbon atoms, and at least one member selected from the group consisting of monoethylenically unsaturated hydrocarbon compounds having 2 to 20 carbon atoms or halogen-substituted derivatives thereof.

2. A method according to claim 1, wherein the copolymer [I] contains 20 to 80 mole % of the monoethylenically unsaturated ester compound, and 80 to 20 mole % of the monoethylenically unsaturated hydrocarbon compound or halogen-substituted derivative thereof.

3. A method according to claim 1 wherein the copolymer [I] contains 30 to 70 mole % of the monoethylenically unsaturate ester compound, and 70 to 30 mole % of the monoethylenically unsaturated hydrocarbon compound or halogen-substituted derivative thereof.

4. A method according to claim 1, wherein the copolymer [I] is an alternating copolymer.

5. A method according to claim 1, wherein the monoethylenically unsaturated ester compound is selected from the group consisting of esters of unsaturated carboxylic acids and unsaturated esters of carboxylic acids.

6. A method according to claim 1, wherein the monoethylenically unsaturated ester compound is selected from the group consisting of esters of an aliphatic carboxylic acid, an aromatic carboxylic acid, a cycloaliphatic carboxylic acid, and mixtures of these acids, or halogen-substituted derivatives of these acids.

7. A method according to claim 6, wherein alcohol moiety of the ester is a hydrocarbon group or a halohydrocarbon group.

8. A method according to claim 7, wherein the hydrocarbon group or the halohydrocarbon group is alkyl, alkenyl, aryl, aralkyl, aralkenyl, alkylaryl, alkenylaryl, cycloalkyl, or cycloalkenyl, or a halogen-substituted derivative thereof.

9. A method according to claim 1, wherein the monoethylenically unsaturated ester compound is selected from the group consisting of esters of unsaturated carboxylic acids.

10. A method according to claim 9, wherein the ester of an unsaturated carboxylic acid is selected from the group consisting of acrylic esters, methacrylic esters, crotonic esters, itaconic esters, maleic esters, and fumaric esters.

11. A method according to claim 9, wherein the ester of an unsaturated carboxylic acid is an acrylic ester or a methacrylic ester.

12. A method according to claim 9, wherein the ester of an unsaturated carboxylic acid is selected from the group consisting of methyl acrylate, ethyl acrylate, butyl acrylate, octyl acrylate, stearyl acrylate, methyl methacrylate, ethyl methacrylate, butyl methacrylate, octyl methacrylate, stearyl methacrylate, ethyl crotonate, diethyl itaconate, diethyl maleate, diethyl fumarate, chloromethyl acrylate, chloroethyl acrylate, chloromethyl methacrylate, and chloroethyl methacrylate.

13. A method according to claim 1, wherein the monoethylenically unsaturated ester compound is selected from the group consisting of unsaturated esters of carboxylic acids.

14. A method according to claim 13, wherein the unsaturated ester of a carboxylic acid contains in the ester group a vinyl, vinylidene, or vinylene group.

15. A method according to claim 13, wherein the unsaturated ester of a carboxylic acid is a vinyl ester of an aliphtic acid.

16. A method according to claim 13, wherein the unsaturated ester of carboxylic acid is selected from the group consisting of vinyl acetate, vinyl propionate, vinyl butyrate, vinyl laurate, vinyl benzoate, vinyl norbornanecarboxylate, vinyl chloroacetate, and allyl acetate.

17. A method according to claim 1, wherein the monoethylenically unsaturated hydrocarbon compound or the halogen-substituted derivative thereof has 3 to 20 carbon atoms.

18. A method according to claim 17, wherein the monoethylenically unsaturated hydrocarbon compound or the halogen-substituted derivative thereof is an aliphatic $\alpha$-olefin.

19. A method according to claim 1, wherein the monoethylenically unsaturated hydrocarbon compound or the halogen-substituted deravative thereof is selected from the group consisting of ethylene, propylene, isobutylene, butene-1, pentene-1, 2-methylbutene-1, 2-methylpentene-1, hexene-1, butene-2, 4-methylpentene-1, 2-methyl-4-phenylbutene-1, octadecene-1, vinyl chloride, vinylidene chloride, 3-methallyl chloride, 2-methyl-4-chloropentene- 1, norbornene, indene, styrene, $\alpha$-methylstyrene, vinyl-toluene, $\alpha$-chlorostyrene, p-chlorostyrene, and p-bromostyrene.

20. A method according to claim 1, wherein the monoethylenically unsaturated hydrocarbon compound or the halogen-substituted derivative thereof is propylene or isobutylene.

21. A method according to claim 1, wherein the copolymer [I] has a polymerizable unsaturated group or such a group as can induce graft-polymerization by extraction of hydrogen therefrom.

22. A method according to claim 21, wherein said group is contained in the copolymer [I] in a proportion of 0.01 to 30 mole percent.

23. A method according to claim 21, wherein said group is contained in the copolymer [I] in a proportion of 0.1 to 10 mole percent.

24. A method according to claim 21, wherein said group is introduced into the copolymer by copolymerizing at least one diene or polyene compound together with the other components.

25. A method according to claim 21, wherein at least one ethylenically unsaturated ester compound having 5 to 22 carbon atoms and at least two polymerizable double bonds is substituted for a part of the monoethylenically unsaturated ester compound.

26. A method according to claim 25, wherein the ethylenically unsaturated ester having at least two polymerizable double bonds is selected from the group consisting of unsaturated ester compounds of acrylic acid.

27. A method according to claim 26, wherein the unsaturated ester compound of acrylic acid is selected from the group consisting of vinyl acrylate, allyl acrylate, isobutenyl acrylate, 1'-butenyl acrylate, crotyl acrylate, cinnamyl acrylate, 3'-cyclopentenyl acrylate, citronellyl acrylate, geranyl acrylate, 5'-norbornene-2'-yl-methyl acrylate, $\beta$-chloroallyl acrylate and cyclohexenyl acrylate.

28. A method according to claim 21, wherein a part of the monoethylenically unsaturated hydrocarbon compound or halogen-substituted derivative thereof is replaced by at least one ethylenically unsaturated hydrocarbon compound or halogen-substituted derivative thereof having 4 to 20 carbon atoms and at least two polymerizable double bonds.

29. A method according to claim 28, wherein the ethylenically unsaturated hydrocarbon compound having at least two polymerizable double bonds or the halogen-substituted derivative thereof is selected from the group consisting of butadiene, isoprene, chloroprene, 1,5-hexadiene, divinyl benzene, p-isopropenylstyrene, p-allylstyrene, 5-ethylidene-2-norbornene, 5-methyl-2,5-norbornadiene, dicyclopentadiene, 1,5-cyclooctadiene, 6-methyl-4,7,8,9-tetra-hydroindene, 4-vinylcyclohexene, aldoline, and p-1'-chloro-1'-propenylstyrene.

30. A method according to claim 1, wherein the acrylic or methacrylic ester having, as the alcohol moiety, a hydrocarbon- or halohydrocarbon-group having 1 to 20 carbon atoms, has, as the alcohol moiety, an alkyl, aryl, aralkyl, alkylaryl, cycloalkyl, alkenyl, aralkenyl, alkenylaryl, or cycloalkenyl group, or a halogen-substituted derivative thereof.

31. A method according to claim 1, wherein the acrylic or methacrylic ester containing, as the alcohol moiety, a hydrocarbon- or halohydrocarbongroup having 1 to 20 carbon atoms is selected from the group consisting of methyl acrylate, ethyl acrylate, butyl acrylate, octyl acrylate, stearyl acrylate, methyl methacrylate, ethyl methacrylate, butyl methacrylate, octyl methacrylate, stearyl methacrylate, chloromethyl acrylate, chloroethyl acrylate, chloromethyl methacrylate, and chloroethyl methacrylate.

32. A method according to claim 1, wherein the vinyl compound is selected from the group consisting of acrylic acid, acryloyl halides, glycidyl acrylate, maleic acid, and substituted derivatives thereof.

33. A method according to claim 1, wherein the vinyl compound is at least one member selected from the group consisting of acrylic acid, methacrylic acid. crotonic acid, itaconic acid, acryloyl chloride, methacryloyl chloride, acryloyl bromide, methacryloyl bromide, hydroxyethyl acrylate, hydroxyethyl methacrylate, methoxyethyl acrylate, ethoxyethyl acrylate, methoxyethyl methacrylate, ethoxyethyl methacrylate, methyl vinyl ether, ethyl vinyl ether, 2-chloroethyl vinyl ether, glycidyl acrylate, glycidyl methacrylate, maleic anhydride, maleimide, N-methylmaleimide, fumaric acid, and maleic acid.

34. A method according to claim 1, wherein 50 to 1,000 parts by weight of at least one member selected from the group consisting of acrylic esters, and methacrylic esters and 0.1 to 200 parts by weight of the at least one vinyl compound are polymerized in the presence of 100 parts by weight of the polymer [I].

35. A method according to claim 1, wherein at least one member selected from the group consisting of acrylic esters, and methacrylic esters, and the at least one vinyl compound are polymerized in the presence of the polymer [I] with a radical-generating catalyst.

36. A method according to claim 35, wherein the radical-generating catalyst is a peroxide, oxygen, an azo compound, heat, light, radiation, or an organomethallic compound.

37. A method according to claim 1, wherein the polymer [II] is applied to a leather in the form of an organic solvent solution.

38. A method according to claim 37, wherein the organic solvent is benzene, toluene, xylene, perchloroethylene, trichloroethylene, acetone, methyl ethyl ketone, ethyl acetate, tetrahydrofuran, 1,4-dioxane, cyclohexanone, or dimethyl formamide.

39. A method according to claim 37, wherein the concentration of the solution is 1 to 50% by weight.

40. A method according to claim 37, wherein the viscosity of the solution is 1 to 100,000 centipoises.

41. A method according to claim 37, wherein the solution is applied to a leather by brushing, spraying, dipping, or knife-coating, in a proportion of 0.01 to 100 g in terms of solids per square mater.

42. A method according to claim 1, wherein the treated leather is dried at a temperature of from ordinary temperature to 200° C.

43. A method according to claim 1, wherein the leather has been colored with a dye or an organic pigment.

44. A method according to claim 43, wherein the dye is a direct dye, an acid dye, a metal-containing dye, a cationic dye, an oil-soluble dye, or a reactive dye.

45. A method according to claim 1, wherein the copolymer [I] is an isobutylene-styrene-ethyl acrylate-allyl acrylate-acryloyl chloride quinquepolymer, an isobutylene-styrene-ethyl acrylate-allyl acrylate quadripolymer, or an isobutylene-methyl acrylateallyl acrylate terpolymer.

46. A method according to claim 45, wherein methyl methacrylate and glycidyl methacrylate or 2-methoxyethyl acrylate; or methyl methacrylate, ethyl acrylate, and acryloyl chloride, are polymerized with benzoyl peroxide in the presence of the quinquepolymer.

47. A method according to clam 45, wherein methyl methacrylate and 2-hydroxyethyl methacrylate or maleic anhydride; or n-butyl methacrylate and methacrylic acid are polymerized with benzoyl peroxide in the presence of the quadripolymer.

48. A method according to claim 45, wherein methyl methacrylate is polymerized with benzoyl peroxide in the presence of the terpolymer.

* * * * *